US006805427B2

(12) United States Patent
Hosono

(10) Patent No.: US 6,805,427 B2
(45) Date of Patent: Oct. 19, 2004

(54) LIQUID EJECTING APPARATUS

(75) Inventor: Satoru Hosono, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 15 days.

(21) Appl. No.: 10/426,957

(22) Filed: May 1, 2003

(65) Prior Publication Data

US 2003/0227529 A1 Dec. 11, 2003

(30) Foreign Application Priority Data

May 1, 2002 (JP) ..... P2002-129612

(51) Int. Cl.[7] ..... B41J 2/165
(52) U.S. Cl. ..... 347/31; 347/35; 347/36
(58) Field of Search ..... 347/31, 35, 36

(56) References Cited

U.S. PATENT DOCUMENTS 5,896,143 A * 4/1999 Matsui et al. ..... 347/24
6,239,817 B1 * 5/2001 Meyer ..... 347/36
6,575,554 B2 * 6/2003 Yoshinaga ..... 347/22
6,616,266 B2 * 9/2003 Neal et al. ..... 347/35

FOREIGN PATENT DOCUMENTS

JP 04-341848 11/1992

* cited by examiner

*Primary Examiner*—Shih-Wen Hsieh
(74) *Attorney, Agent, or Firm*—Sughrue Mion, PLLC

(57) ABSTRACT

While a head scanning mechanism and a sheet feed mechanism are being operated, ink droplets are ejected from nozzle openings of a recording head, whereby a liquid ejecting apparatus performs recording on recording medium. Further, just below the scanning region of the recording head, a liquid absorption part is laid on a surface of a platen supporting the recording medium; and a height of the absorption member located in the portion corresponding to a medium width edge portion of each of print recording media to be printed having different width dimensions is made larger than height of the absorber located in another portion.

10 Claims, 6 Drawing Sheets

D3<D2

D3<D2

LIQUID EJECTING APPARATUS

The present application is based on Japanese Patent Application No. 2002-129612, the entire contents of which are incorporated herein by reference.

BACKGROUND OF THE INVENTION

1. Field of the Invention

The present invention relates to a liquid ejecting apparatus which ejects droplets such as ink droplets from a nozzle opening of a head. Specifically, the invention is related to a ink jet recording apparatus which records a character or an image on a sheet-like recording medium such as recording sheet and a recording film, and particularly suitable for frameless print.

2. Related Art

In a liquid ejecting apparatus such as a printer or a plotter, an ink droplet is ejected from a recording head mounted on a carriage with reciprocating movement in a main scanning direction of the carriage, while recording sheet is transported in a sub-scanning direction crossing to the main scanning direction. The ejection operation of ink droplet and the transporting operation of recording sheet are performed in connection with each other, whereby a character and an image are recorded on the recording sheet.

In such the recording apparatus, the recording sheet and the inside of the apparatus are stained with the ink droplets ejected at the outside of the recording sheet. Further, the ink droplets ejected at the outside of the recording sheet are easy to become misty. In case that this ink mist adheres to the vicinity of the nozzle opening of the recording head, the ejection of the ink droplets becomes unstable by the adhering ink mist. In order to prevent disadvantage caused by these unnecessary ink droplets, in JP-A-4-341848, a recording apparatus has been proposed in which an ink absorber that absorbs the unnecessary ink droplets ejected at the outside of the recording sheet is arranged on the backside of the recording sheet.

Further, in this kind of recording apparatus, there is an apparatus having a mode in which printing is performed throughout the entire region of the recording sheet, that is, a frameless print mode. In this frameless print mode, print data of somewhat wider range than the area of the recording apparatus is prepared and ink droplets are ejected up to the region over four sides of the recording sheet. Therefore, this recording apparatus includes the ink absorber on the backside of the recording sheet.

Regarding an ink droplet for realizing high quality of image, generally, its amount of ink must be very small, for example, 2 pL (picoliter). Since this very small amount of ink droplet receives viscosity resistance of air considerably, a distance in which the ink droplet can fly is very short. Therefore, only in case that the ink absorber in the conventional apparatus is simply provided, there is fear that a certain amount of ink droplets do not reach the ink absorber and they become misty.

Further, in case that a distance from the recording head to the ink absorber is shortened, a new trouble that the recording sheet is caught by the ink absorber when rolling traces are left in the recording sheet is produced. Therefore, only in case that the distance to the absorber is simply shortened, high quality of a recording image in the frameless print mode cannot be obtained.

SUMMARY OF THE INVENTION

In view of such the circumstances, an object of the invention is to provide a liquid ejecting apparatus which can catch and collect the necessary liquid droplets thereby to prevent occurrence of mist.

The invention is proposed in order to achieve its object. According to the first aspect of the invention, in a liquid ejecting apparatus which comprises a head that forms on a nozzle surface on which plural nozzle openings are formed, a head scanning mechanism that moves the recording head in a head scanning direction, a medium transporting mechanism that transports a recording medium in a transporting direction crossing to the head scanning direction, and a platen on which the recording medium is transported by the medium transporting mechanism and which opposes the recording medium to the nozzle surface of the head, and which ejects droplets from the nozzle openings while it is operating the head scanning mechanism and the medium transporting mechanism thereby to perform recording on the recording medium, the apparatus is characterized in that:

on the platen, plural support projections supporting the recording medium are spaced in the scanning direction of the recording head, and a liquid absorption part is disposed in a position lower than each support projection; and the liquid absorption part includes first liquid absorbing members for front and back ends of the recording medium which are arranged on upstream and downstream sides in the transporting direction with respect to the support projections, and second liquid absorbing members for side edges of the recording medium which are arranged so as to be in parallel with the transporting direction of the recording medium.

The second liquid absorbing members are disposed at predetermined positions so that said apparatus is adapted to standardized recording mediums.

According to the second aspect of the invention, the liquid ejecting apparatus in the first aspect is characterized in that the second liquid absorbing member is formed of material different from material of the fist liquid absorbing members.

According to the third aspect of the invention, the liquid ejecting apparatus in the first aspect is characterized in that the second liquid absorbing member is constituted so that on the first liquid absorbing members extended to a downward portion of side edges of the standardized recording medium.

According to the fourth aspect of the invention, the liquid ejecting apparatus is characterized in that the side edge liquid absorbing member is formed of harder material than the material of the front and back end liquid absorbing members thereby to heighten surface accuracy.

According to the fifth aspect of the invention, the liquid ejecting apparatus in any of the first to fourth aspects is characterized in that the side edge liquid absorbing member includes asbestos.

DETAILED DESCRIPTION OF THE PREFERRED EMBODIMENTS

An embodiment of the invention will be described below with reference to drawings. In the following description, as an example of a liquid ejecting apparatus according to the invention, an ink jet printer (hereinafter referred to simply as a printer) is taken.

Figure 1:
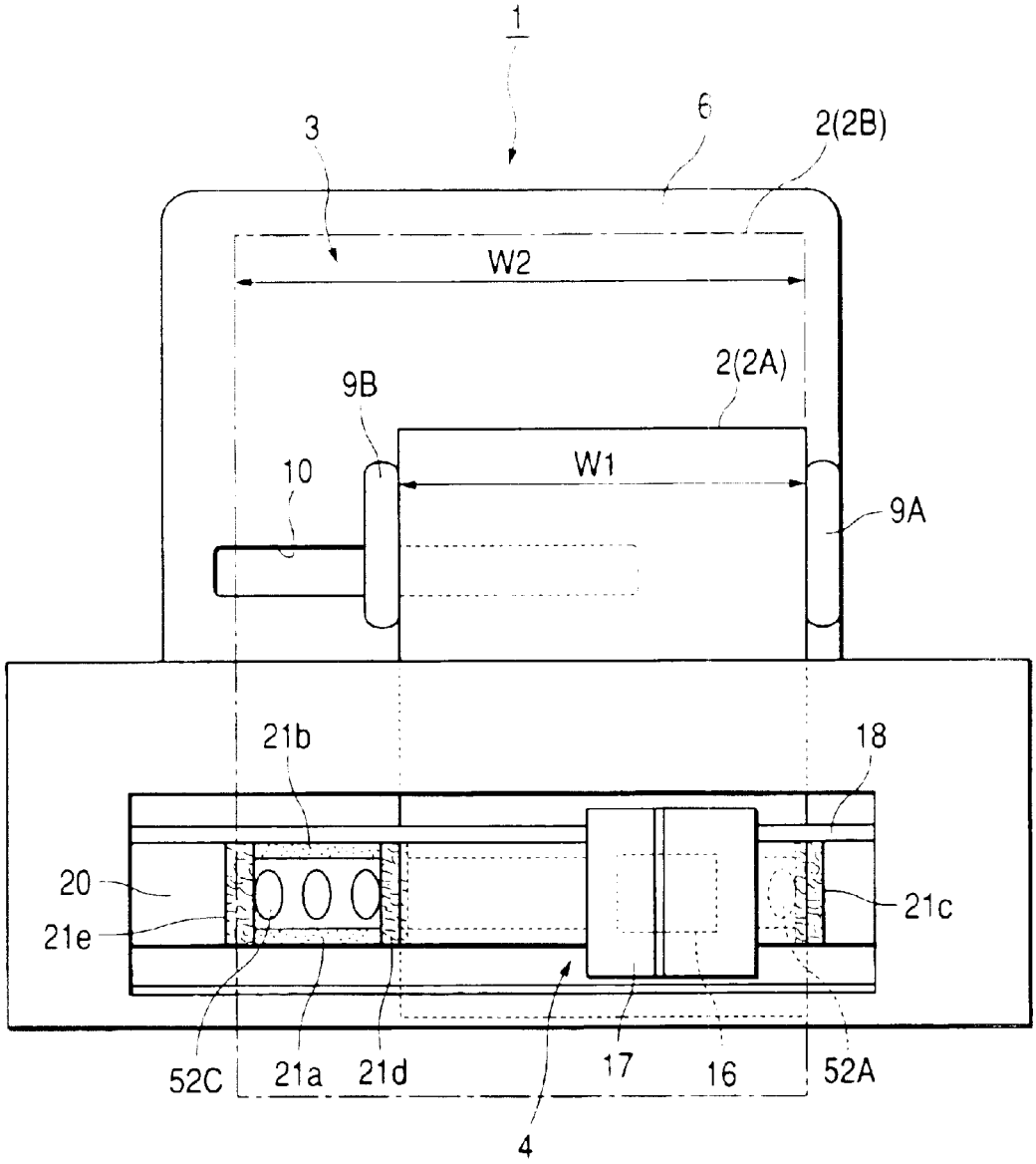
FIG. 1 is a plan view showing the schematic structure of a printer in an embodiment.
Figure 2:
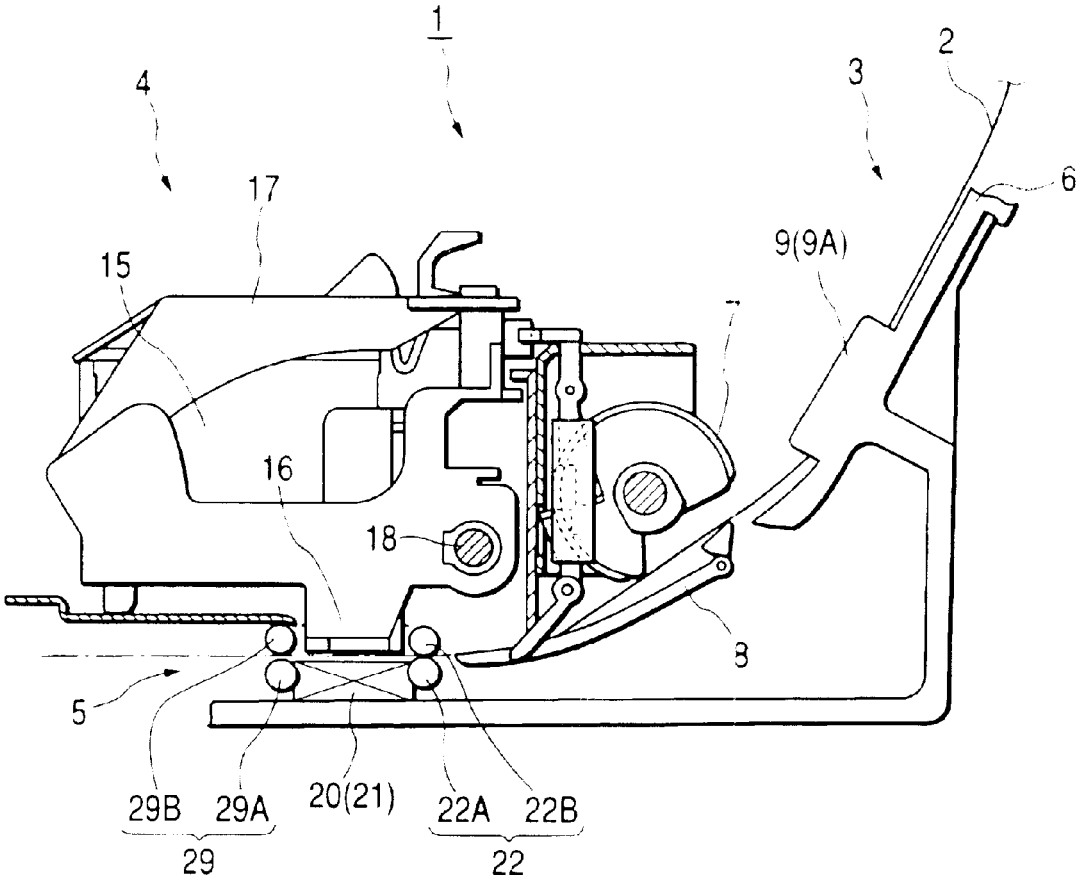
FIG. 2 is a schematic side view of the inside of the printer in the embodiment.

Firstly, the whole constitution of the printer will be described. Here, FIG. 1 is a plan view showing the schematic structure of the printer, and FIG. 2 is a schematic side view of the printer inside. As shown in these figures, a printer 1 includes a feeding unit 3 which supplies recording sheet 2 that is a kind of sheet-like recording medium, a recording unit 4 which performs recording of images on the supplied recording sheet 2, and a discharge unit 5 which transports the recording sheet 2 on which recording has been performed in a sheet discharge direction.

The feeding unit 3 functions as a medium supply section, and is set at the backside portion in the printer 1. This feeding unit 3 includes a support plate 6 which can support the plural recording sheets 2 in a stack state, a sheet feeding roller 7 which supplies the recording sheet 2 on the support plate 6 to the recording unit 4 side by friction, and a guide plate 8 which guides the recording sheet 2 supplied by the sheet feeding roller 7 to the recording unit 4 side.

Further, so-called roll sheet rolled on a surface of a cylindrical core material can be also supplied from this feeding unit 3. In this case, a roll sheet holder (not shown) that is a separate body is attached to the feeding unit 3.

On the support plate 6, a pair of left and right edge guides 9 which regulate a position in a width direction of the recording sheet 2 by coming into contact with left and right side edges of the recording sheet 2 (that is, left and right edges) are provided. Namely, this edge guide 9 comprises a right edge guide 9A located on the right side viewed from a front surface of the printer 1, and a left edge guide 9B located on the left side.

In the embodiment, the right edge guide 9A is provided for a right end portion of the support plate 6 integrally with the support plate 6, and the left edge guide 9B is provided movably in the left and right direction that is a head scanning direction. Therefore, in the support plate 6, a guide groove 10 into which an attachment base (not shown) of the left edge guide 9B is fitted is formed extensively in the left and right direction, and the left edge guide 9B is attached movably along this guide groove 10 in the head scanning direction. A user moves the left edge guide B in the left and right direction correspondingly to the sheet width of the recording sheet 2 to be used, and brings guide surfaces of the edge guides 9A and 9B into contact with the side edges of the recording sheet 2, whereby the left and right positions of the recording sheet 2 supported on the support plate 6 are regulated. Hereby, by a pair of edge guides 9A and 9B, positional regulation is performed in relation to the recording sheet 2 of plural standardized sizes, for example, post card size to A4 size. Further, by these edge guides 9A and 9B, the recording sheet 2 can be also guided straight to the recording unit 4 from the feeding unit 3.

The recording sheet 2 of post card size corresponds to recording sheet of recordable minimum width, and the recording sheet of A4 size corresponds to recording sheet of recordable maximum width. However, the recordable sheet size is not limited to this example, but it can be determined arbitrarily. For example, the recordable sheet size may be set in a range from business card size that is smaller than the post card size to A3 size that is larger than the A4 size.

To the sheet feeding roller 7, a rotary shaft of a sheet feeding motor 11 (refer to FIG. 3) is coupled, and this sheet feeding roller 7 rotates by drive power of the sheet feeding motor 11. When this sheet feeding roller 7 rotates, the recording sheet 2 located at the uppermost portion, of the plural recording sheets 2 supported on the support plate 6, comes into contact with the surface of the sheet feeding roller 7, is transported with rotation of the sheet feeding roller 7, and is supplied to the recording unit 4. The sheet feeding motor 11 is electrically connected to a printer controller 12 shown in FIG. 3, and its operation is controlled by a drive signal from this printer controller 12.

The recording unit 4 comprises a carriage 17 which has a cartridge holder that holds an ink cartridge 15 detachably and a recording head 16; a guide shaft 18 which guides this carriage 17 in a main scanning direction (sheet width direction) that is the head scanning direction; a sheet feed mechanism which transports the recording sheet 2; a carriage scanning mechanism which moves the carriage 17 along the guide shaft 18; a platen 20 which places thereon the recording sheet fed by the sheet feed mechanism and opposes it to a nozzle surface of the recording head 16; and a liquid absorption part 21 which is provided on the surface of the platen 20 and absorbs ink droplets ejected at the outside of the print sheet.

Figure 4:
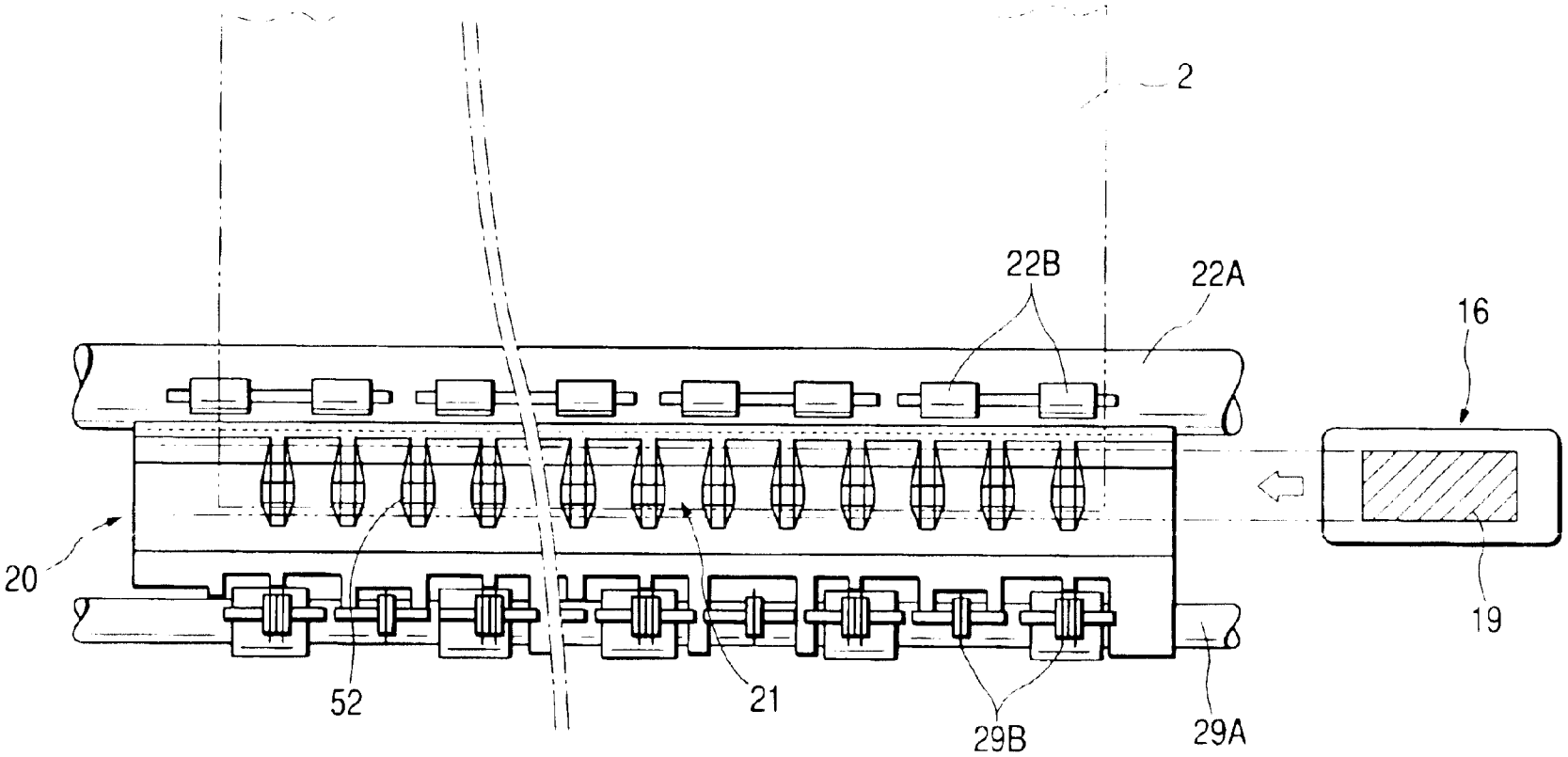
FIG. 4 is a plan view showing a recording unit, a liquid absorption part, and their surrounding structure.

As shown in FIG. 4, the recording head 16 has a nozzle plate 19 on its surface (leading end surface) opposite to the recording sheet 2. In this nozzle plate 19, plural nozzle arrays comprising plural nozzle openings are arranged laterally. Accordingly, the outer surface of the nozzle plate 19 functions as a nozzle surface of the invention. For example, seven nozzle arrays are arranged laterally, and the arrangement direction of these nozzle arrays is fitted to the head scanning direction. In the recording head 16, ink supplied from the ink cartridge 15 is ejected from each nozzle opening correspondingly to print data.

Regarding this recording head 16, as long as it can eject ink droplets from the nozzle openings, it may be constituted arbitrarily. For example, a recording head 16 can be used, which uses as a pressure-generating element a piezoelectric vibrator that is a kind of electromechanical conversion element. Further, a recording head 16 may be used, which uses as a pressure-generating element a magnetostrictive element that is a kind of electromechanical conversion element. Further, a recording head 16 may be used, which uses as a pressure-generating element a heat-generating element.

The sheet feed mechanism transports the recording sheet 2 in a sheet feed direction orthogonal to the head scanning direction. The sheet feed mechanism in the embodiment comprises a sheet feed roller 22 shown in FIG. 2, a sheet feed motor 23 shown in FIG. 3, and the printer controller 12 shown in FIG. 3. The sheet feed roller 22, as shown in FIGS. 2 and 4, is composed of a drive roller 22A located on the downside and a driven roller 22B located on the upside. To the drive roller 22A, a rotary shaft of the sheet feed motor 23 is coupled, and this drive roller 22A rotates by drive power of the sheet feed motor 23. Further, the driven roller 22B rotates in accordance with the rotation of the drive roller 22A. This sheet feed motor 23 is electrically connected to the printer controller 12, and its operation is controlled by a drive signal from this printer controller 12.

The carriage scanning mechanism moves the carriage 17 in the main scanning direction. The carriage scanning mechanism in the embodiment is composed of a pulse motor 24 shown in FIG. 3, a power transmission part which moves the carriage 17 by rotation of this pulse motor 24, and the printer controller 12 which controls the operation of the pulse motor 24. The power transmission part can have the arbitrary constitution. For example, it is composed of a drive pulley connected to a rotary shaft of the pulse motor 24, idler pulleys provided at other right and left ends of the printer 1, and a timing belt laid between the drive pulley and the idler pulleys and connected to the carriage 17. In this carriage scanning mechanism, the recording head 16 can be moved in a wider range than the width of the recording sheet 2 of the recordable maximum width. In the embodiment, the recording head can be moved in a wider range than the width of the recording sheet 2 of A4 size that is the recordable maximum width.

The liquid absorption part 21 is arranged, just below the scanning region of the recording head 16, on the back surface side of the recording sheet 2. This liquid absorption part 21, as shown in FIG. 4, is arranged on a surface of the platen 20 supporting the recording sheet 2 from the downside. On the backside of the platen 20 (upstream side in the sheet feed direction), the drive roller 22A and the driven roller 22B of which the sheet feed roller 22 of the sheet feed mechanism is composed are arranged. On the front side of the platen 20 (downstream side in the sheet feed direction), a drive roller 29A and a sheet press roller 29B of which a sheet discharge roller 29 described later of the discharge unit 5 is composed are arranged. Namely, the recording sheet 2 is guided from the feeding unit 3 onto the platen 20 of the recording unit 4 by the sheet feed roller 22; and after a print operation by the recording head 16 has been completed on the platen 20, the recording sheet 2 is guided successively from the platen 20 of the recording unit 4 to the discharge unit 5 by the sheet discharge roller 29.

The platen 20 is a plate-like member, and on its surface, plural diamond ribs 52 functioning as support projections are arranged in a row at regular intervals in the moving direction of the recording head 16. Each of the diamond ribs 52 protrudes upward from the platen surface, and its upper surface becomes a contact surface supporting the recording sheet 2, whereby the recording sheet 2 is supported partially by each of the diamond ribs 52.

Figure 5A:
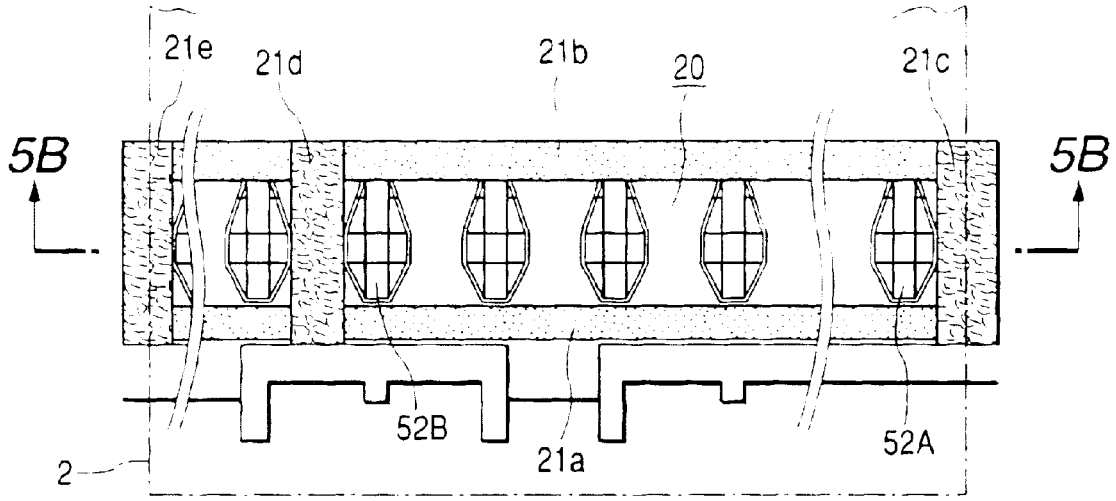
FIGS. 5A and 5B are main portion enlarged views respectively showing the liquid absorption part in the embodiment.
Figure 5B:
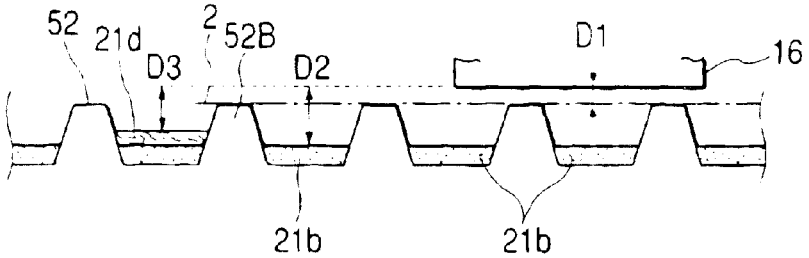

The liquid absorption part 21, as shown in FIGS. 5A and 5B, comprises a front end liquid absorbing member 21*a* which is arranged, on the surface of the platen 20, on an downstream side of the array of the diamond ribs 52 in the transporting direction, a back end liquid absorbing member 21*b* which is arranged, on the surface of the platen 20, on a upstream side thereof, and side edge liquid absorbing members 21*c*, 21*d* and 21*e* arranged in positions on the surface of the platen 20 corresponding to left and right side edges of the recording medium of which a left and right width is standardized. Each surface height of the side edge liquid absorbing members 21*c*, 21*d*, and 21*e* is set higher than that of the front and back end liquid absorbing members 21*a* and 21*b*. As the liquid absorption part 21, a porous member made of, for example, felt and sponge, which is good in liquid absorption, is adopted.

In the embodiment, in order to simplify description, as shown in FIG. 1, two kinds of recording sheet 2A and 2B of which widths are standardized to W1 and W2 are used. Therefore, as shown in FIGS. 1, 5A and 5B, the front end liquid absorbing member 21*a* is arranged on the downstream side of the array of the diamond ribs 52, the back end liquid absorbing member 21*b* is arranged on the upstream side thereof with uniform thickness, and the side edge liquid absorbing members 21*c*, 21*d* and 21*e* are arranged on the front and back end liquid absorbing members 21*a* and 21*b*.

Regarding arrangement of the side edge liquid absorbing members 21*c*, 21*d* and 21*e*, specifically, at portions corresponding to sheet width edge portions of each recording sheet 2A and 2B (right side edge portion and left side edge portion), that is, on the outside of the diamond rib 52A supporting the right side edge portion of each recording sheet 2A, 2B (on the side opposite to the recording sheet 2A, 2B and on the right side in the figure), the side edge liquid absorbing member 21*c* is laid elongatedly in the sheet side edge direction (transporting direction); on the outside of the diamond rib 52B supporting the left side edge portion of the narrow recording sheet 2A (on the side opposite to the recording sheet 2A and on the left side in the figure), the side edge liquid absorbing member 21*d* is laid elongatedly in the sheet side edge direction; and on the outside of the diamond rib 52C supporting the left side edge portion of the wide recording sheet 2B(on the side opposite to the recording sheet 2B and on the left side in the figure), the side edge liquid absorbing member 21*e* is laid elongatedly in the sheet side edge direction.

Each of the side edge liquid absorbing members 21*c*, 21*d* and 21*e* may be constituted so that on the sponge-made front and back end liquid absorbing members extended to the downside of the left and right side edges of the size-standardized recording medium (recording sheet 2A, 2B), liquid absorbing members made of material different from the material of the front and back end liquid absorbing members are disposed. For example, on the sponge-made front and back end liquid absorbing members 21*a* and 21*b*, an ink absorber made of porous resin, asbestos, or compressed fiber may be stacked as the side edge liquid absorbing member.

Further, the constitution of each of the side edge liquid absorbing members 21*c*, 21*d* and 21*e* is not limited to the constitution in which it are disposed on the front and back end liquid absorbing members 21*a* and 21*b*, but porous resin-made absorbers that are thicker than the front and back end liquid absorbing members 21*a* and 21*b* may laid independently.

FIG. 5B shows a relation in height among these absorbers 21*a* to 21*e*. When a distance D1 from the recording sheet 2 surface to the nozzle surface is, for example, 1.2 mm, a distance D2 from the nozzle surface to each upper surface of the front and back end liquid absorbing members 21*a*, 21*b* is 4 to 5 mm, and a distance D3 from the nozzle surface to each upper surface of the side end liquid absorbing members 21*d*, 21*d*, 21*e* is 3 to 4 mm. Namely, the surface height of each side liquid absorbing member 21*c*, 21*d*, 21*e* is set higher by about 1 mm than the surface height of each front and back end liquid absorbing member 21*a*, 21*b*.

Figure 6:
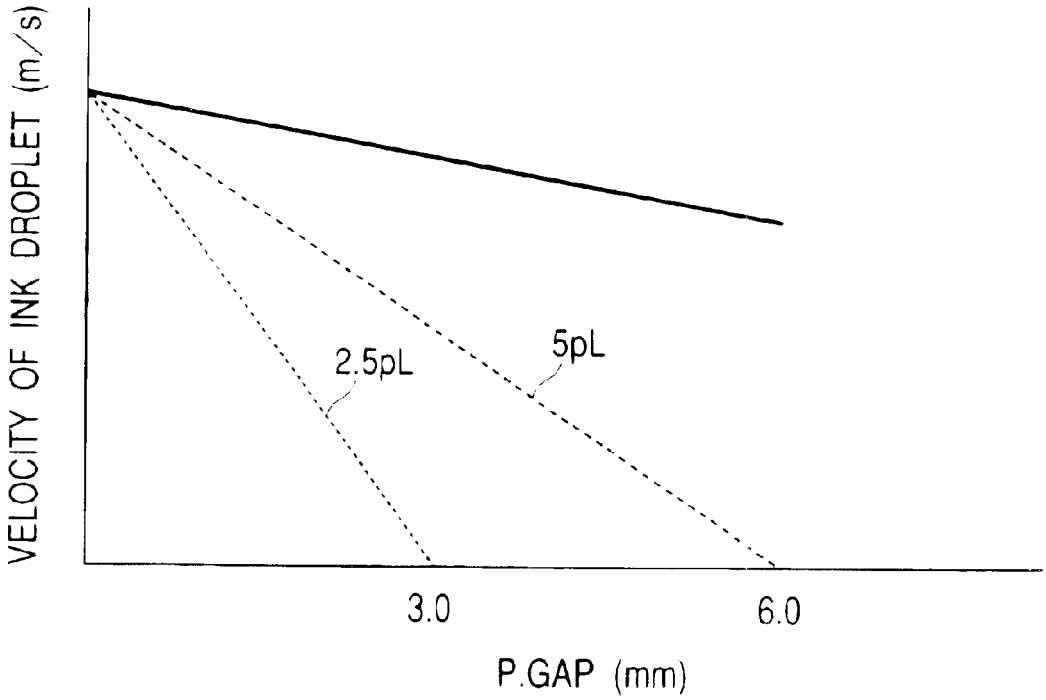
FIG. 6 is an explanatory view showing a correlation between velocity of ink droplet and a platen gap.

This surface height is set on the basis of correlation between velocity of ink droplet and a platen gap, shown in FIG. 6. Velocity of ink droplet is plotted in ordinate and a platen gap is plotted in abscissa. The larger the amount of ink droplet is (about several tens pL), the smaller inclination is (The velocity of ink droplet does not decrease very much). However, as the amount of ink droplet becomes smaller (for example, about 5 pL), the inclination becomes larger. Further, when the amount of ink droplet becomes half (for example, about 2.5 pL), the inclination becomes further larger. For example, in case that the ink droplets of 5 pL splash 6 mm away, the ink droplets of 2.5 pL splash only about 3 mm away.

Taking ink droplets becoming misty into consideration, in case that printing at a leading end portion and a back end portion of the recording sheet 2 and printing at left and right side edge portions of the recording sheet 2 are compared with each other, extra shot at the front and back ends of the recording sheet 2 is performed once to several times per one sheet, and the extra shot at the left and right side edges is performed every time the recording head 16 reciprocates. For example, at the printing time of the leading end and back end portions of the recording sheet 2, 2 to 8 pass (the number of scan) is enough; and at the printing time of the side edge portions, 20 to 100 pass is required. Therefore, the amount of ink necessary for extra shot at the front and back ends of the recording sheet 2 becomes small comparatively, and that at the left and right side edges becomes large comparatively. Accordingly, if the ink droplets for extra shot in recording at the side edge portions can be collected, the actual problem is solved.

For this reason, in case that the distance D2 from the nozzle surface to each upper surface of the front and back end liquid absorbing members 21*a*, 21*b* is set to 4 to 5 mm, and the distance D3 from the nozzle surface to each upper surface of the side end liquid absorbing members 21*d*, 21*d*, 21*e* is set to 3 to 4 mm, the ink droplets in the extra shot regions of frameless print do not become misty but they can be absorbed effectively in the liquid absorption part 21.

Since a gap from the upper surface of the diamond rib 52 to each upper surface of the front and back end liquid absorbing members 21*a*, 21*b* is secured to 1.8 to 3.8 mm, even if rolling traces and curve exist in recording sheet 2 in case of using roll sheet, such a trouble that the leading end of the recording sheet 2 is caught by the liquid absorbing member 21*a* is not produced.

The discharge unit 5 includes a sheet discharge roller 29 composed of a drive roller 29A and plural sheet press rollers 29B having different shapes which are driven adjacently to the upside of this drive roller 29A and of which each shaft is rotatably supported at the front end portion of the platen 20 at the predetermined interval. To the drive roller 29A, the sheet discharge motor 30 (refer to FIG. 3) of which the operation is controlled by the printer controller 12 is coupled. The drive roller 29A rotates by the drive power of this sheet discharge motor 30, and the sheet press roller 29B rotates in accordance with the rotation of the drive roller 29A. The recording sheet 2 on which recording has been performed is nipped between the drive roller 29A and the sheet press roller 29B and transported in the discharge direction.

Figure 3:
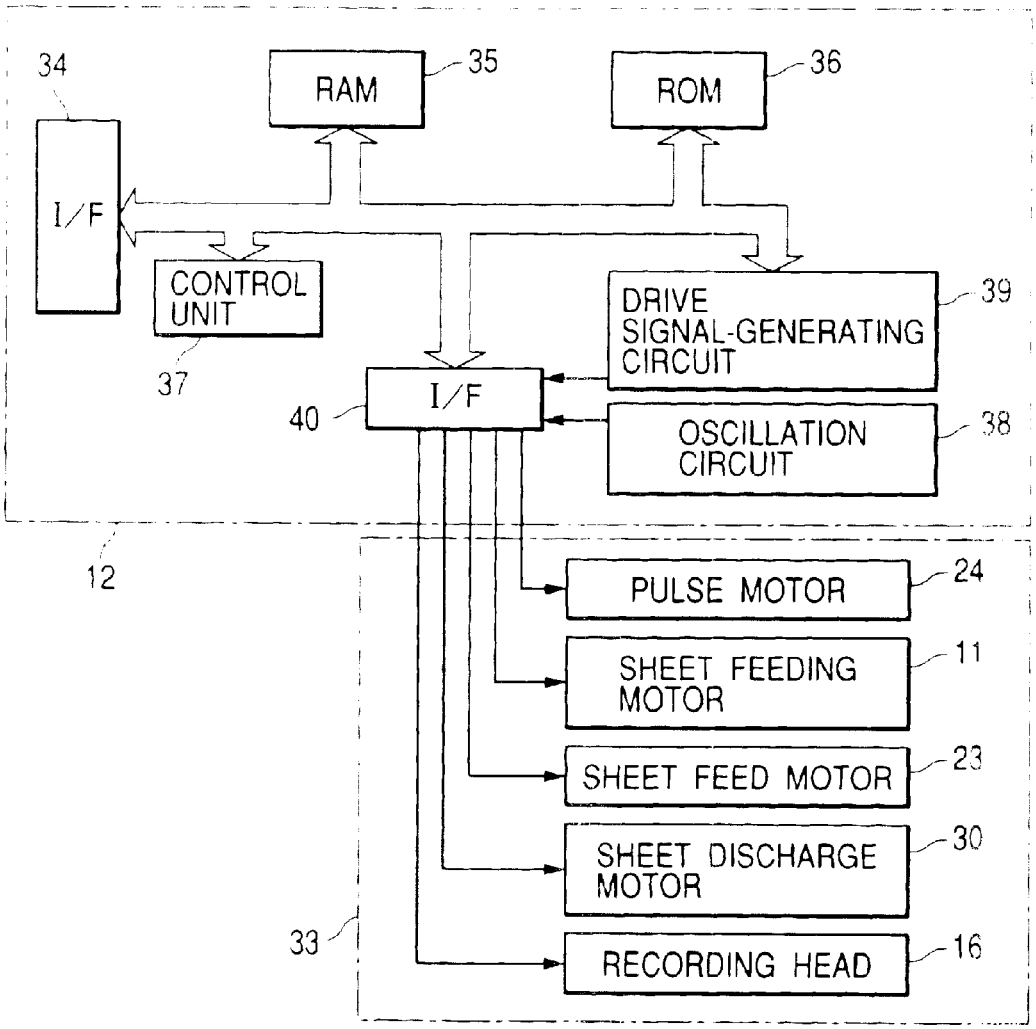
FIG. 3 is a block diagram for explaining the electric constitution of the printer in the embodiment.

Next, the electrical constitution of this printer 1 will be described. This printer 1, as shown in FIG. 3, includes the printer controller 12 and a print engine 33.

The printer controller 12 functions as a controller which controls the operations of the recording unit 4 and the feeding units 3. This printer controller 12 includes an interface 34 which receives print data from a not-shown host computer, a RAM 35 which stores various data therein, a ROM 36 which stores a control routine for processing of various data, a control unit 37 composed of a CPU, an oscillation circuit 38 which generates clock signals, a drive signal generating circuit 39 which generates drive signals supplied to the recording head 16, and an interface 40 for transmitting printing data into which print data is decompressed for each dot and drive signals to the print engine 33.

Further, the print engine 33 includes the pulse motor 24, the sheet feeding motor 11, the sheet feed motor 23, the sheet discharge motor 30, and the recording head 16.

The interface 34 receives from the host computer any one of character code, graphic function and image data, or print data composed of plural data. Further, a control command which specifies a recording mode to be transmitted from the host computer (recording mode set data), and a control command which specifies a frameless print mode (frameless print mode set data) are input through this interface 34. On the other hand, from the interface 34, busy signals (BUSY) and acknowledge signals (ACK) are output to the host computer.

Further, the control unit 37 controls the operation of the printer 1. Namely, on the basis of the print data and control command transmitted from the host computer, and the control routine stored in the ROM 36, the control unit 37 operates each of the parts constituting the print engine 33.

Next, the operation of this printer 1 will be described.

Firstly, the recording sheet 2 is set in the feeding unit 3. This setting of recording sheet 2 is performed as follows: Firstly, the left edge guide 9B is moved to the left so that a distance from the right edge guide 9A to the left edge guide 9B becomes wider than sheet width of the recording sheet 2. Thereafter, the recording sheet 2 is placed between the right edge guide 9A and the left edge guide 9B, and next the left edge guide 9B is moved to the right so that the left side edge portion of the recording sheet 2 comes into contact with the guide surface of the left edge guide 9B.

When the recording sheet 2 has been set, the printer 1 performs a recording operation on the basis of the print data and control command transmitted from the host computer. Namely, the printer controller 12 (control unit 37) operates appropriately each of parts constituting the print engine 33 on the basis of the control command to record an image on the recording sheet 2, and correspondingly to this operation, in the feeding unit 3, the sheet feeding motor 11 is operated and the recording sheet 2 is successively supplied to the recording unit 4. In the recording unit 4, the pulse motor 24, the recording head 16 and the sheet feed motor 23 are operated, and ink droplets are allowed to impact against the supplied recording sheet 2 thereby to perform recording.

When the recording sheet 2 has been placed in a recording start position, the carriage 17 is moved by the operation of the pulse motor 24 in the head scanning direction, and the recording head 16 operates during moving of the carriage 17 thereby to eject ink droplets from the nozzle openings. Namely, the recording head 16 moves in the main scanning direction.

At this time, in the frameless print mode, the ink droplets are ejected also to the outside of the edge portion of the recording sheet 2. However, since the liquid absorption part 21 made of material that can absorb and hold the ink droplet is laid on the surface of the platen 20 supporting the recording sheet 2, ink mist in the extra shot region of the frameless print can be surely absorbed in the liquid absorption part 21.

Especially, at the portions of the platen 20 corresponding to the sheet width edge portions (right side edge portion and left side edge portion) of each recording sheet 2, the side edge liquid absorbing members 21*c*, 21*d* and 21*e* of which each height is increased and of which each surface accuracy is improved are arranged. Therefore, a very small amount of ink droplet that is liable to become misty can be surely absorbed in the side edge liquid absorbing members.

When the recording head 16 has moved across a region to be recorded, the operation of the pulse motor 24 is stopped to stop the carriage 17, and the sheet feed motor 23 is again operated to transport the recording sheet 2 by one pitch.

Subsequently, the main scan of the recording head 16 and the transportation of the recording sheet are performed repeatedly, and images are recorded on the recording sheet 2 in order from the upstream side in the sheet feed direction.

The invention is not limited to the above embodiment but various changes and modifications can be made without departing from the scope of the patent claims.

For example, regarding the liquid absorption part 21, at the portions corresponding to the sheet width edge portions (right side edge portion and left side edge portion) of two kinds of recording sheet 2A, 2B, the side edge liquid absorbing members 21*c*, 21*d*, and 21*e* are arranged. However, the invention is not limited to this. As long as the liquid absorption part 21 is arranged correspondingly to the kind of the standardized recording sheet, side edge liquid absorbing members corresponding to roll sheet of 89 mm width or 127 mm width may be arranged.

Further, regarding the recording head 16, though the recording head 16 having the nozzle plate 19 is exemplified in the embodiment, the invention is not limited to this constitution. For example, a recording head 16 may be used, in which nozzle openings are formed integrally in a flow path forming member that forms an ink flow path extending from a common ink chamber through a pressure chamber to the nozzle opening. Under this constitution, a face on which the nozzle openings are provided functions as a nozzle surface.

Further, regarding the recording medium, though the recording sheet 2 is exemplified in the embodiment, it is not limited to the recording sheet 2. This recording medium may be, for example, a sheet-like resin film. Further, the recording medium is not limited to the sheet-like recording medium but may be a rolled recording medium.

Though the printer is exemplified in the embodiment, the invention is not limited to the printer but it may be applied to, for example, a plotter.

As described above, according to the invention, the following good advantages are obtained.

The liquid absorption part in the liquid ejecting apparatus of the invention comprises the front and back end liquid absorbing members which are arranged on the upstream side and the downstream side in the transporting direction with respect to the support projections, and the side edge liquid absorbing members arranged in positions corresponding to the left and right side edges of the recording medium of which left and right width is standardized; and each surface height of the side edge liquid absorbing members is set higher than that of the front and back end liquid absorbing members. Therefore, it is possible to absorb, in the liquid absorption part with high probability, the ink droplets shot extra when recording is performed on the recording medium side edges where the ink droplets are easy to become misty, so that it is possible to prevent a bad influence caused by the ink mist. Since each surface height of the front and back end liquid absorbing members is not higher than that of the side edge liquid absorbing members, occurrence of disadvantage that the leading end of the recording medium is caught by the front and back end liquid absorbing members can also avoided.

Further, since use of the hard absorbing material in the side edge liquid absorbing member can heighten the surface accuracy, the gap control between the side edge liquid absorbing member and the nozzle surface is easily performed.

What is claimed is:

1. A liquid ejecting apparatus comprising:

a head having a nozzle surface on which plural nozzle openings are formed;

a head scanning mechanism that moves the head in a head scanning direction, a medium transporting mechanism that transports a recording medium in a transporting direction crossing to said head scanning direction, and a platen on which the recording medium is transported by the medium transporting mechanism while so as to oppose the recording medium to the nozzle surface of the head from which droplets are ejected through the nozzle openings, support projections arrayed on the platen so as to be spaced in the head scanning direction, and a liquid absorption device disposed on a position lower than the support projections on the platen; and the liquid absorption device including at least one first liquid absorbing member for one of front and back ends of the recording medium which are arranged on at least one of an upstream side and a downstream side of the transporting direction with respect to the support projections, and at least one second liquid absorbing member for a side edge of the recording medium disposed so as to be substantially in parallel to the transporting direction, and a surface height of the second liquid absorbing member is set higher than a surface height of the first liquid absorbing member.

2. The liquid ejecting apparatus according to claim 1, wherein said second liquid absorbing member is formed of material different from material of the first liquid absorbing member.

3. The liquid ejecting apparatus according to claim 2, wherein said second liquid absorbing member is formed of a harder material than the material of the first liquid absorbing member.

4. The liquid ejecting apparatus according to claim 1, wherein said second liquid absorbing member is disposed on the first liquid absorbing member which is extended to a downward portion of side edges of the recording medium.

5. The liquid ejecting apparatus according to claim 1, wherein said second liquid absorbing member includes asbestos.

6. The liquid ejecting apparatus according to claim 1, wherein a plurality of the second liquid absorbing members are disposed at predetermined intervals so that said liquid ejecting apparatus is adapted to plural standardized recording-mediums.

7. The liquid ejecting apparatus according to claim 1, wherein a pair of the first liquid absorbing member are provided both of the upstream and downstream sides in the transporting direction with respect to the support projections so as to be in parallel with the scanning direction.

8. The liquid ejecting apparatus according to claim 1, wherein opposite ends of the second liquid absorbing member are provided on the pair of the first liquid member.

9. The liquid ejecting apparatus according to claim 1, wherein at least three of the second liquid absorbing members are provided so that said liquid ejecting apparatus is adapted to plural standardized recording mediums.

10. The liquid ejecting apparatus according to claim 1, the apparatus is served as an ink jet recording apparatus.

* * * * *